US005249489A

United States Patent [19]

Weisman

[11] Patent Number: 5,249,489

[45] Date of Patent: Oct. 5, 1993

[54] NUT EJECTING SOCKET INSERT

[76] Inventor: Alan S. Weisman, 720 Spring St., Richmond, Calif. 94804-4125

[21] Appl. No.: 940,497

[22] Filed: Sep. 4, 1992

[51] Int. Cl.[5] ..... B25B 13/02

[52] U.S. Cl. ..... 81/124.1; 81/125

[58] Field of Search ..... 81/124.1, 125

[56] References Cited

U.S. PATENT DOCUMENTS 2,488,894 11/1949 Barrett ..... 81/124.1
2,651,229 9/1953 Lenz ..... 81/124.1
2,676,506 4/1954 Schultz ..... 81/124.1
2,720,804 10/1955 Brown ..... 81/124.1 X
4,919,020 4/1990 Huebschen ..... 81/125

*Primary Examiner*—James G. Smith

[57] ABSTRACT

A driving tool comprising a magnet and compression spring assembly insertable into a socket is disclosed. The insertable assembly comprises a flexible stem internal to the spring in the axis of rotation allowing the spring to compress and proving a straightening and travel limiting function. The nut or bolt is conveniently placed at the top edge of the socket for easy removal following disassembly, or positioning prior to a driving operation.

11 Claims, 2 Drawing Sheets

NUT EJECTING SOCKET INSERT

BACKGROUND OF THE INVENTION

This invention resides in the field of tools which use a magnet to position a workpiece such as a nut or bolt. More particularly, the present invention is a device which utilizes a spring in a socket to position and hold a nut or the like before assembly or after disassembly.

The problem of positioning and retaining a fastening member such as a nut, bolt or the like is well known and has been present since the advent of the workpieces themselves, and particularly has been a problem with the socket type wrench. Fastening operations in most environments using a socket often necessitate manual placement of the nut or the like on the mating member such as the bolt stem, where such is possible, slowing assembly. In long-reach or constrained environments, manual placement may be difficult and may even expose the operators to hazards in some circumstances.

Devices previous to my present invention which are directed to ejecting or holding a nut or the like are costly to machine and assemble, and do not easily and inexpensively afford the ability to adapt an existing deep-well socket to a nut-ejecting and positioning socket.

U.S. Pat. No. 2,488,894, issued Nov. 22, 1949 to Barrett describes a magnetless device having a spring inside a machined retainer cage and mated plunger to eject a nut.

U. S. Pat. No. 2,651,229, issued Sep. 8, 1953 to Lenz is directed to a magnetless two-piece driving tool having an internal spring bias.

U.S. Pat. No. 2,676,506, issued Apr. 27, 1954 to Shultz describes a magnetless socket wrench comprising a mechanical bolt retaining mechanism.

U.S. Pat. No. 2,720,804, issued Oct. 18, 1955 to Brown describes a tool having an elongated hollow member with a movable magnet having a bore therethrough within the hollow member.

U.S. Patent No. 4,919,020, issued Apr. 24, 1990 to Huebachen describes a socket tool having a spring biased magnet assembly inside a hollow bore, wherein the spring is embedded in adhesive.

None of the devices prior to my present invention meet the need for a functional, low cost assembly which may adapt a conventional socket to a magnetic nut ejecting socket. Such a tool is much desired.

SUMMARY OF THE INVENTION

It is the general object of my invention to provide an improved driving tool and socket which avoids the disadvantages and shortcomings of previously described tools, and which offers structural and operational advantages. It is an object of my invention to provide an insertable assembly for placement in a socket well which accomplishes the task of holding a nut, bolt or the like in position ready for fastening or following disconnection near the edge of the socket well. It is a further object of my invention to provide such a tool in a form that is economical to manufacture and assemble.

In accordance with my present invention, I have overcome the deficiencies in prior devices and met the objectives described above. The device of my invention comprises a socket head coupled to a driving shank at one end of the socket head and a socket Well opening away from the shank cooperating therewith to receive a corresponding rotatable fastening member; a base disk having a top face and a bottom face; a flexible stem permanently attached to the base disk at a bottom stem-end and having an opposite top stem-end; a top disk having a stem face and a nut face concentrically positioned with and retained to the top stem-end; a magnet permanently affixed to the top disk on the nut face, and; a helical compression spring concentric with the stem abutting the top face of the base disk on one end and abutting the stem face of the top disk at the other end.

In a preferred embodiment, the base disk and flexible stem assembly is molded from plastic, and has at the top end extending from the base disk a tip which is insertable through the top disk from the stem face through a central hole, retaining the top disk against the compression spring. Preferably, the tip is molded from plastic and is generally in the shape of a cone, but may be any shape which allows the tip to be inserted through and centrally positioned on the top disk. Preferably, the top disk is provided with a depression concentric with the central hole, for receiving the tip and avoiding the tip obstructing the flush mounting of a flat surfaced magnet.

The preferred embodiment comprises holding means to detachably affix the base disk centrally in the base of the socket well.

The magnet, stem and spring are selected in size and strength so as to consistently place the nut, bolthead or the like near the end of the socket for ease of removal from the driving tool. In the preferred embodiment, it is desirable to place the spring in compression during normal assembly to urge the straightening and full extension of the stem and further to maintain such position after repeated use of the driving tool.

The tool of my present invention finds particular usefulness in manufacturing operations involving robotics. The unique design features result in the consistent placement of the workpiece at a known position following disassembly and consistent positioning of the magnet retaining means within the socket well, a necessity for robotic assembly.

Among other factors, I have found the device of my invention to be substantially easier to manufacture and assemble than the spring and magnet devices described in the art. The cageless travel limiting stem, internal within the spring, provides a lighter and simpler device to brine and hold a workpiece at the socket edge.

Surprisingly, I found the socket insert assembly of the driving tool of my invention to be easily adaptable to and easy to use with various sized commercially available sockets, and the cost of materials used in manufacturing the insert assembly to be surprisingly low.

DETAILED DESCRIPTION OF THE INVENTION

By the term "socket", it is meant any form of generally cylindrical machined elements having a bore therethrough with one end machined on the interior to receive and impart a rotational driving force to a nut, bolt or the like with a nut-engaging portion; the other socket end adapted to receive a shank from a rachet or other driving mechanism. "Socket well" refers to the bore portion of the socket consisting of the nut-engaging portion and any portion of the bore between the nut engaging portion and the shank mating portion of the socket.

By the term "fastening member", it is meant a nut, bolt or other rotatable element having a machine head or the like capable of being driven by a socket.

Figure 2:
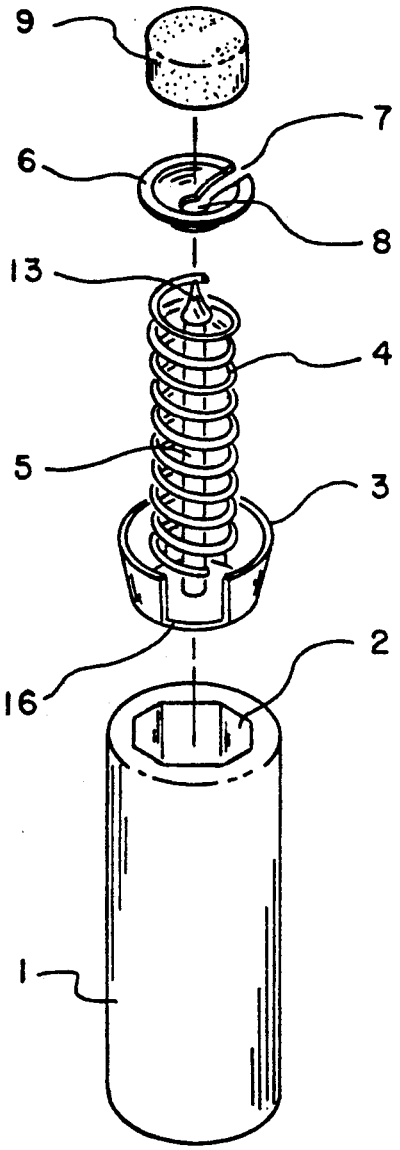
FIG. 2 is an exploded view of a preferred deep-well embodiment of the socket insert, exposing the elements thereof.
Figure 1:
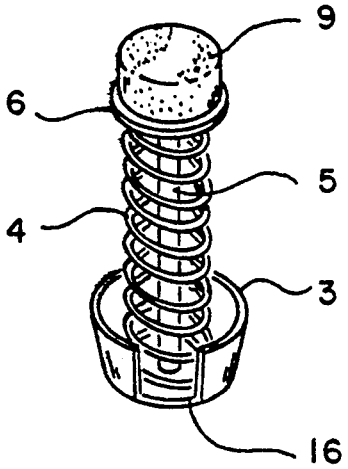
FIG. 1 depicts assembled socket insert in the normal position.

FIG. 1 shows the assembled insert outside of the socket. Referring now to FIG. 2, where specific elements and features of my invention may be seen, the deep-well embodiment is depicted comprising a socket 1 with the top edge in view.

In the exploded view diagram, the socket insert base disk 16 is sized in diameter to fit within the socket well abutting the base of the well. Base disk 16 is preferably completely circular. Flexible stem 5 is permanently affixed at the center of the top side of base disk 16 perpendicular thereto. Preferably, base disk 16 and flexible stem 5 are formed from a thermoplastic in an injection molding process of the kind well known in the art. Stem 5 is sized in diameter to allow the stem to deform in response to a force exerted upon top stem-end in the direction of the base disk 16, as will be further detailed below with reference to FIG. 3 and FIG. 4. Still referring to FIG. 2, compression spring 4 is positioned concentric with flexible stem 5. Preferably, spring 4 is a metal helical compression spring which maintains a substantially constant diameter during compression. Physical properties of commonly used spring materials useful in my invention are given in *Handbook of Mechanical Spring Design,* published by the Associated Spring Corporation. I have had the best results, in the preferred embodiment of my invention, using helical clock or flat steel springs having a circular cross-section.

Spring 4 abuts the top side of base disk 16 at the spring bottom end. Top disk 6 has about the same, or preferably slightly less diameter as base disk 16 and is attachably affixed to the top stem-end. Top disk 6 is preferably metallic as it is known that magnetic strength of a magnet is increased on one face if a metal mass is magnetically engaged near the opposite pole.

In the preferred embodiment, top disk 6 is metallic and is provided with a central disk bore s therethrough. Also in the preferred embodiment, top disk 6 is provided with depression 7 concentric with the central hole in the direction toward the base disk when the top disk is installed on flexible stem 5. The preferred means of attaching top disk 6 to stem 5 is provided in a tip 13, preferably substantially cone-shaped, which is permanently affixed to and preferably molded integral with stem 5 and base disk 16. The diameter of disk bore 8 and the dimensions of the tip 13 are selected in light of the ability of tip to yield to allow insertion through the central hole from stem side of the top disk. Top disk 6 having disk bore s should preferably be locatable upon stem cone 13 and when a moderate force is applied to the nut face of top disk 6. In such assembly, stem tip 13 diameter yields, allowing the disk to pass over the base of stem tip 13.

In an alternate preferred embodiment of FIG. 2, the top disk incorporates a slot 7, radially extending the central bore 8 to the edge. In this embodiment, the slot allows for the assembly of the top disk at the top stem-end by passing the stem along the slot to the central bore 8.

The above preferred and alternate top disk assembly step is carried out with compression spring 4 in place around stem 5, the spring preferably being placed in compression, or "pre-stressed", as a result of assembly of the top disk, such that spring 4 firmly abuts the stem face of top disk 6, further firmly urging outward to force the top disk to positively abut the underside of stem tip 13 about the top rim of central bore 8. The outward bias of spring 4 in the normal assembled position should not however, be so great as to result in a yielding of the stem tip 13.

With the top disk in place following the above preferred assembly method, permanent magnet 9 may be permanently affixed to the top side thereof. The magnet should preferably have a high retentivity, a high remanence, and a high coercive force. These properties are generally found in magnets made from hardened steel and its alloys, and also in ceramic material magnets. Magnet 9 is preferably a round ceramic-type magnet, and affixed to the top disk 6 with an epoxy or other well-known strong bonding composition. In doing so, stem tip 13 is preferably also bonded to the top disk 6. Magnet 9 may alternatively be ring shaped; however, I have found it preferable that the top side of the magnet be solid to avoid accumulation of dirt and grease and the like during repeated operation of the tool.

The driving bore 2 of the socket may be hexagonal in shape, or alternatively may have any other multiply-ridqed edge to engage a nut, bolt or the like. Further, the nut-engaging shape of the socket driving bore may continue from the top edge for any length toward the shank end of the socket. As is typical with many deep-well type sockets presently commercially available, the driving bore extends partially down the socket well in the direction of the shank end, where the socket well transitions to a smooth faced bore for some length between the driving bore and the shank mating bore. My invention is useful with sockets of both types, although I have found it somewhat more advantageous when such a smooth transition bore is present between the driving bore and the shank mating bore.

In the preferred embodiment of my invention, I have found it particularly advantageous to provide the base disk 16 with sidewall 3 integral therewith. The sidewall is preferably molded from plastic with the base disk and stem, and extends around the outer rim of the base disk in a plurality of sections. If such a sidewall is provided, I have further found it advantageous to form the sidewall extending upward from the base disk with a slight angle outward from the base disk, preferably at an angle of from between about 95 degrees to about 100 degrees relative to the face of the base disk, depending upon the height of the sidewall and the rigidity of the material from which it is formed. The purpose of such preferably outwardly extending sidewalls is to provide a holding force for retaining the base disk in the bottom of the socket well. In order to accomplish such a result, the diameter of the upper rim of the plurality of sidewalls 3 is sized to be normally slightly larger than the inside diameter of the bore section in which it is to be located.

Referring now to FIG. 2, the socket insert is assembled and placed in normal position within the socket well. In the preferred embodiment the top of magnet 9 is normally positioned somewhat below the top edge of the driving bore, such that the driving bore may engage the fastening member, while still allowing for exposure of the fastening member above the socket edge to enable easy removal of the fastening member from the magnet. It is particularly desirable and suggested that when the nut-ejecting insert is to be used with power tools the top of magnet 9 is placed below the top edge of the socket well to avoid the possibility of the nut inadvertently being thrown from the driving tool and endangering the operator or by-standers.

Figure 3:
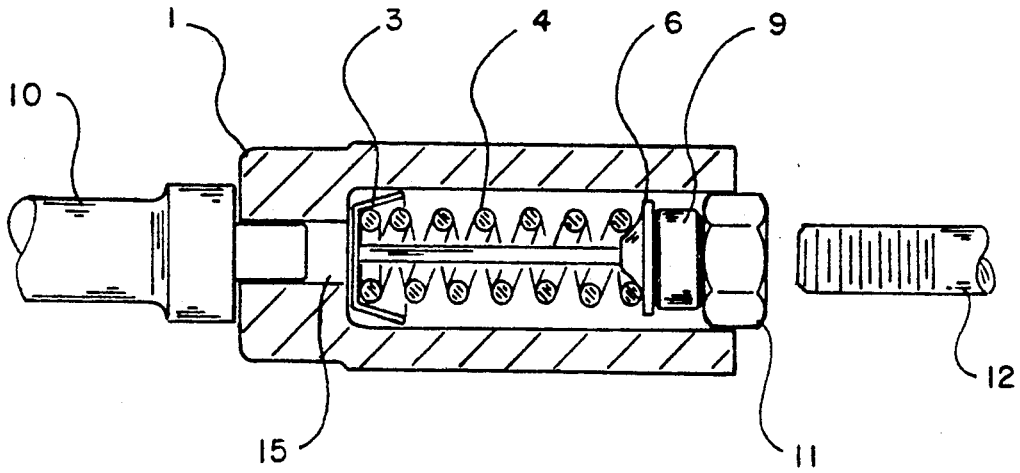
FIG. 3 shows in side cross-section the deep-well embodiment in operating position with magnetically-engaged nut in the normal position.

Still referring to FIG. 3, the preferred embodiment of the driving tool is depicted in the normal ready position to drive fastening member 11 onto threaded stem 12. It will be readily apparent to those familiar with sockets and driving tools that the same operation occurs, but in reverse, during disassembly or removal of the fastening member from the stem or the like. To drive the fastening member onto stem 12, shank 10 imparts a driving force to socket 1 through the shank bore 15. The shank 10 at the other end may be connected to a rachet, hand driver or power tool of the well known type. Shank bore 15 may be of various geometry, but is typically square and provided with well-known means for retaining the socket on the shank. Fastening member 11 is in this diagram a nut, and is preferably magnetically engaged and within the socket well at least a portion of the nut length such that the driving bore is effective to cause the threaded nut to rotate and positively engage the threaded portion on the mated threaded stem 12.

Figure 4:
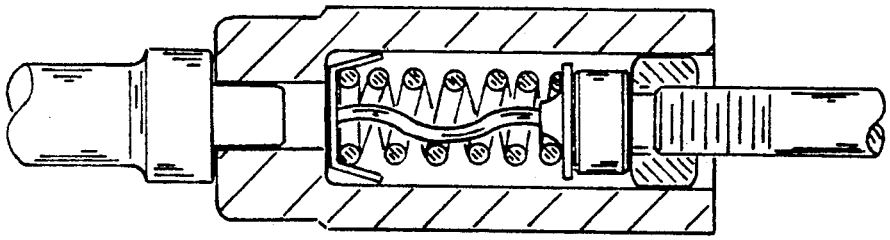
FIG. 4 shows the deep-well socket and insert in the nut-driving position.

Referring now to FIG. 4, the driving tool in the same cross-section view as shown in FIG. 3 is depicted in the driving position, which is the same position as would occur in the case of disassembly, of course rotating the driving tool and shank in the opposite direction. Among other key features, when force is applied through the shank in the direction of the fastening member, the magnet and top disk move into the socket well in the direction of the shank end, compressing the spring. As depicted in FIG. 4, flexible stem 5 deforms out of its normal and fully extended position substantially in the axis of the socket rotation to a non-linear shape, as the distance between the base disk and top disk is lessened. I have found the plastic material from which the base disk and stem preferably formed to be adequately flexible and capable of the intended deformation in the practice of my invention when the stem diameter is between about 1/32 and about ⅛ inches. The optimum diameter selected is a matter of choice and also dependant upon the size of the socket bore and rigidity of the plastic material selected. Further, I have found the operation of my invention to be best when the maximum compression of the spring is limited and thus the distance between the base and top disk is limited to about one-half, preferably one-third of the distance between the base and top disks in the normal position; however, my invention is not confined to such preferable conditions. When the driving operation is completed, the socket is retracted in the direction of the shank away from the fastening member, and the fastening member or corresponding stem is magnetically disengaged from the magnet, with the socket insert assembly remaining in place within the socket well.

It will be apparent to one skilled in the art that various modifications to and variations of the socket insert and driving tool of my invention are possible without departing from the true scope and spirit of my invention. Such variations and modifications to the above specification and attached drawings referenced therein are intended to be within the scope of the appended Claims presented below.

I claim:

1. A nut ejecting insert for use with a socket comprising;

a base disk having a bottom face and a top face insertable into a socket well:

a flexible stem permanently attached to said top face of said base disk at one end and having a top stem-end;

a top disk having a stem face and a nut face centrally affixed to said stem-end;

a magnet permanently affixed to said top face of said top disk, and;

a compression spring concentric with said stem abutting said top face of said base disk on one end, and said stem face of said top disk at the other end.

2. A driving tool comprising a shank and a socket coupled to said shank at one end of said socket;

a socket well opening away from said shank cooperating therewith to receive a corresponding rotatable fastening member;

a base disk having a bottom face and a top face insertable into said socket well:

a flexible stem permanently attached to said top face of said base disk at one end and having a top stem-end;

a top disk having a stem face and a nut face centrally affixed to said stem-end;

a magnet permanently affixed to said top face of said top disk, and;

a compression spring concentric with said stem abutting said top face of said base disk on one end, and said stem face of said top disk at the other end.

3. The insert as recited in claim 1 wherein said flexible stem is molded from plastic.

4. The insert as recited in claim 1 wherein said flexible stem and said base disk are molded from plastic.

5. The insert as recited in claim 1 wherein said compression spring is helical.

6. The insert as recited in claim 4 wherein said top disk is metallic.

7. The inserted as recited in claim 6 wherein said top disk has a centrally placed bore therethrough and further has a depression concentric with said bore and wherein said flexible stem has at the top stem-end a tip, said tip having a diameter greater than the diameter of said bore.

8. The insert as recited in claim 7 wherein said tip is substantially cone-shaped.

9. The insert as recited in claim 6 wherein said top disk is provided with a slot extending radially from a central bore allowing said flexible stem to pass from said disk edge to said central bore.

10. The socket insert as recited in claim 1 further comprising holding means on a base side of said base disk to detachably affix said base disk centrally in said socket well.

11. The socket insert as recited in claim 10 wherein said holding means comprises a sidewall molded from plastic integral with said base disk extending upward from the edge of said top face of said base disk biased toward said socket well to impart a holding force against said socket well when the base disk is inserted in said socket.

* * * * *